United States Patent [19]

Sherman et al.

[11] 4,261,941

[45] Apr. 14, 1981

[54] PROCESS FOR PREPARING ZEOLITE-CONTAINING DETERGENT AGGLOMERATES

[75] Inventors: John D. Sherman, Chappaqua; Arthur F. Denny, Katonah, both of N.Y.

[73] Assignee: Union Carbide Corporation, New York, N.Y.

[21] Appl. No.: 52,191

[22] Filed: Jun. 26, 1979

[51] Int. Cl.[3] ..... C11D 1/22; C11D 3/12; C11D 3/37; C11D 11/00

[52] U.S. Cl. ..... 264/117; 252/131; 252/140; 252/174; 252/174.21; 252/174.23; 252/174.25; 252/179; 252/540; 252/559; 264/118

[58] Field of Search ..... 23/313 R; 252/131, 140, 252/174, 174.21, 174.23, 174.25, 179, 540, 559; 264/117, 118

[56] References Cited

U.S. PATENT DOCUMENTS

| | | | |
|---|---|---|---|
| 3,324,038 | 6/1967 | Chaffee | 252/545 |
| 3,714,051 | 1/1973 | Milesi | 252/135 |
| 4,096,081 | 6/1978 | Phenicie | 252/135 X |

FOREIGN PATENT DOCUMENTS

| | | | |
|---|---|---|---|
| 2433485 | 2/1975 | Fed. Rep. of Germany | 252/131 |
| 2401987 | 3/1979 | France | 252/174.25 |
| 1429143 | 3/1976 | United Kingdom | 252/131 |

*Primary Examiner*—Dennis L. Albrecht
*Attorney, Agent, or Firm*—Richard G. Miller

[57] ABSTRACT

Zeolite-containing agglomerates which rapidly disperse in water are prepared by admixing molten polyethylene glycol with a hot aqueous solution of alkylbenzene sulfonate, blending the resulting mixture with hydrated zeolite A crystals and thereafter drying and comminuting the blend.

1 Claim, No Drawings

PROCESS FOR PREPARING ZEOLITE-CONTAINING DETERGENT AGGLOMERATES

The present invention relates in general to surfactant compositions, and more particularly to zeolite-containing surfactant agglomerates suitable as adjuvants in low phosphate or phosphate-free household laundry detergent compositions.

It has heretofore been proposed to include the sodium cation forms of certain crystalline zeolites of the molecular sieve type in laundry detergent compositions to provide the water-softening function formerly performed by phosphate builders. The phosphate compounds have been found to be undesirable because of their adverse impact upon the environment.

Although the zeolites have been found to be excellent sequestering agents for the calcium and magnesium cations of hard water when thoroughly dispersed in the medium, considerable difficulties have been encountered in formulating zeolite-containing detergent compositions which permit rapid dissociation of the zeolite constituent from the other components of the composition. This failure results in insufficient softening of the water and deposition of undispersed agglomerates of zeolite-containing materials on the fabric being laundered. While, from the standpoint of maximum dispersibility, the zeolite constituent should be incorporated into the detergent formulation as individual crystals not adhering to any other constituent, it is found that the zeolite crystals will not remain uniformly distributed throughout the packaged detergent composition—an obvious disadvantage. On the other hand, incorporating the zeolite crystals into aggregates or particles of the total detergent composition by any common method, such as spray drying, results in their uniform distribution in the detergent composition, but slow dispersion throughout the water used in laundering. The reasons for this behavior are not fully understood, but it does not appear to be solely a function of the solubility of the matrix composition.

It is, therefore, the general object of the present invention to provide a zeolite-containing agglomerate which when admixed with conventional laundry detergents remains uniformly distributed during packaging, shipping and storing, and which upon contact with water rapidly disperses to distribute the zeolite crystals therethrough.

This and other objects which will be apparent from the specification are accomplished in accordance with the present invention by the zeolite-containing agglomerate particles which comprise (a) crystals of a three-dimensional zeolite of the molecular sieve type containing ion-exchangeable alkali metal cations, said zeolite being contained in a combined matrix of an intimate mixture of (b) a water soluble alkylbenzene sulfonate in which the alkyl group contains from about 9 to about 15 carbon atoms, said alkylbenzene sulfonate being present in an amount of 10 to 25 parts by weight per 100 parts by weight hydrated zeolite crystals, and (c) a polyethylene glycol having a freezing range within 53° to 63° C. and a molecular weight of 3,000 to 19,000 in an amount of from 2.5 to 6.5 parts by weight per 100 parts by weight hydrated zeolite crystals.

The preferred alkylbenzene sulfonates are the sodium or potassium salts or a mixture thereof in which the alkyl groups are essentially or entirely linear, but branched chain alkyl groups are acceptable, especially in admixture with linear alkyl groups. Examples of such sodium and potassium alkylbenzene sulfonates in which the alkyl groups contain from about 11 to 13 carbon atoms in both linear and branched chain configuration are set forth in U.S. Pat. Nos. 2,220,099 and 2,477,383. Particularly preferred are linear alkylbenzene sulfonates in which the average number of carbon atoms in the alkyl groups is about 12.

The preferred polyethylene glycols are those which have average molecular weights of from about 3,000 to 7,500 and which melt in the range of 53° to 63° C. These water-soluble polymers are commercially available under the trade name "Carbowax". (Union Carbide Corporation).

The particular species of zeolitic molecular sieve constituent employed is not a narrowly critical factor provided it contains cations which are exchangeable with the calcium and magnesium cations of hard water and which upon exchange do not introduce objectionable compounds into the water. These exchangeable cations are most commonly alkali metal cations, particularly sodium. Sodium Zeolite A, as described in detail in U.S. Pat. No. 2,882,243, is highly preferred because of its ability to sequester calcium cations. Sodium Zeolite X as described in U.S. Pat. No. 2,882,244 is also a particularly desirable species of zeolite for the present purposes. Moreover, mixtures of sodium zeolite A and sodium zeolite X containing about 40 to 70 weight percent of each species are found to exhibit a synergistic effect in sequestering calcium and magnesium cations when both are present in hard water. Such a mixture is used to advantage in the present compositions.

EXAMPLE 1

An agglomerated composition of the present invention containing 100 parts by weight (hydrated) sodium zeolite A, 5 parts by weight polyethylene glycol and 9 parts by weight linear alkylbenzene sulfonate was prepared as follows:

100 grams of polyethylene glycol having an average molecular weight of 6,000 was heated to slightly above its pour point and admixed with an aqueous solution of 180 grams of a sodium alkylbenzene sulfonate in 1020 grams of water at the same temperature. To this mixture was added 2,000 grams of hydrated sodium zeolite A with thorough blending. The blended product was dried in an air oven at 100° C. and crushed to form 20×60 mesh (Standard U.S. Sieve Series) particles. The particles had excellent crispness and very readily dispersed in water.

What is claimed is:

1. Process for preparing a zeolite-containing agglomerate suitable for incorporation into detergent formulations which comprises providing a polyethylene glycol having an average molecular weight of about 6000 and having a freezing range of about 60°-63° C., heating said polyethylene glycol to above its freezing point, forming an aqueous solution of a sodium linear alkylbenzene sulfonate in which the alkyl groups contain an average of 12 carbon atoms and heating said solution to essentially the same temperature as the said polyethylene glycol, admixing said polyethylene glycol and sodium linear alkylbenzene sulfonate and blending with said mixture crystals of hydrated sodium zeolite A, the resulting blend containing 5 parts by weight of polyethylene glycol and 9 parts by weight of sodium linear alkylbenzene sulfonate per 100 parts by weight of hydrated sodium zeolite A, drying the blended product in air at about 100° C. and thereafter particulating the dried mass to form 20×60 mesh standard U.S. Sieve Series particles.

* * * * *